US006488165B1

(12) United States Patent
Hidding

(10) Patent No.: US 6,488,165 B1
(45) Date of Patent: Dec. 3, 2002

(54) GRIPPING AND SEALING CAP

(76) Inventor: Douglas J. Hidding, 412 Caesar Dr., Barrington Hills, IL (US) 60010

( * ) Notice: Subject to any disclaimer, the term of this patent is extended or adjusted under 35 U.S.C. 154(b) by 0 days.

(21) Appl. No.: 09/645,702

(22) Filed: Aug. 24, 2000

(51) Int. Cl.[7] ..... B65D 53/00
(52) U.S. Cl. ..... 215/344; 215/256; 215/351
(58) Field of Search ..... 215/256, 341, 215/343, 344, 345, 349, 351, DIG. 1; 222/541.5, 541.9, 541.6

(56) References Cited

U.S. PATENT DOCUMENTS

| | | | | |
|---|---|---|---|---|
| 4,106,653 A | * | 8/1978 | Martinelli | 215/256 |
| 4,333,577 A | | 6/1982 | Mumford | |
| 4,416,383 A | | 11/1983 | Frahm et al. | |
| 4,452,363 A | | 6/1984 | Davis | |
| 4,526,282 A | | 7/1985 | Dutt et al. | |
| 4,531,649 A | * | 7/1985 | Shull | 215/DIG. 1 |
| 4,549,667 A | | 10/1985 | Dullabaun | |
| 4,848,614 A | | 7/1989 | Csaszar | |
| 4,884,707 A | * | 12/1989 | Crisci | 215/256 |
| 4,907,708 A | | 3/1990 | Csaszar | |
| 4,911,316 A | | 3/1990 | Tackles | |
| 5,232,125 A | * | 8/1993 | Adams | |
| 5,259,522 A | | 11/1993 | Morton | |
| 5,383,558 A | * | 1/1995 | Wilkinson et al. | 215/344 |
| 5,450,973 A | | 9/1995 | Ellis et al. | |
| 5,462,185 A | | 10/1995 | Ingram et al. | |
| 5,487,481 A | | 1/1996 | Sander et al. | |
| 5,611,446 A | | 3/1997 | Ingram et al. | |
| 5,687,865 A | * | 11/1997 | Adams et al. | 215/256 |
| 5,904,259 A | * | 5/1999 | Hidding et al. | 215/256 |

FOREIGN PATENT DOCUMENTS

| | | | |
|---|---|---|---|
| FR | 2354256 | * | 6/1978 |

* cited by examiner

*Primary Examiner*—Nathan J. Newhouse
(74) *Attorney, Agent, or Firm*—Baker & McKenzie

(57) ABSTRACT

The closure of the present invention provides a seal a variety of neck configurations, including substantially new and different neck profiles. The top of the cap, which may or may not include a valve, has side wall depending from the top of the cap and a skirt extending further downwardly from the side wall. The inside surface of the cap has an elongated sealing flange extending downwardly and outwardly from the underside of the top of the cap. The lower tip of the sealing flange is preferably disposed outside, in the radial direction, of the inside diameter of the latch bead formed at the base of the side wall of the cap. The length of the sealing flange, its position on the underside of the cap and the length-to-basewidth ratio of the flange keep it from becoming misaligned or twisted. The inside surface of the wedge-shaped sealing flange is preferably disposed at an obtuse angle from the plane of the top of the cap. The side wall of the cap may include a concave section or seat immediately above the latch bead and a stop above the concave section which has a slightly convex configuration. The seat and stop provide a way of locating the outside surface of the neck finish relative to the sealing flange to ensure that a consistent pressure is applied at the interface between the sealing flange and the upwardly facing surface of the neck finish. The extended-length sealing flange of the cap of the present invention enhances the stability of liners, such as foam liners, preferred by some bottlers as a extra measure of sealing.

7 Claims, 5 Drawing Sheets

GRIPPING AND SEALING CAP

SUMMARY OF THE INVENTION

The present invention relates to a closure for use in the bottled water industry. In particular, the present invention is an improved gripping and sealing cap for use on multi-gallon (e.g. 5-gallon) plastic and glass water bottles of the type which are typically inverted and placed on bottled water dispensers.

BACKGROUND OF THE INVENTION

There are a number of suppliers of reusable plastic five-gallon containers used to deliver water to consumers. While the bottles provided by the manufacturers of five-gallon containers tend to be made with a generally standard neck finish, substantial differences among manufacturers does exist, and the bottle neck finishes on bottles produced by a single manufacturer can have some significant variations. These variations present a challenge for cap suppliers who need to provide a single cap design which is capable of sealing substantially different bottle neck finishes. Further sealing challenges arise from the fact that bottles are typically re-used and re-filled over and over again. In the process of their being stored at various uncontrolled locations, transported and handled by persons who may or may not handle the bottles carefully, bottle neck finishes become nicked and otherwise damaged. Such damaged neck finishes make it even more difficult for a single cap design to seal effectively in a consistent manner all of the bottles processed by a bottling facility.

While standardization has occurred among various suppliers of five-gallon containers used in the bottled water industry, variability remains a fact with which closure suppliers must deal. Standardization, however, makes introducing any improvements in the design of bottle neck finishes difficult, because any significant change in the design of a bottle neck finish will render it non-standard, and unacceptable. Bottlers cannot contend with the problem of associating a particular closure with more than one style of container neck finish, and the ability of container manufacturers to make changes in the neck finish of their containers is significantly impaired by standardization. The problem of dealing with a multiplicity of neck profiles has been a recognized problem in the bottled water industry. For example, see U.S. Pat. No. 4,911,316 (and references discussed in the specification thereof). The '316 patent discloses a typical closure for five-gallon containers and discusses the ability of the cap shown in the '316 patent to accommodate neck profiles which differ very slightly from one to another. See FIG. 3 of U.S. Pat. No. 4,911,316. A cap for five gallon containers to be commercially viable, it must work well with the full range of bottle neck finishes which are in circulation in the distribution systems of customers.

Changes or improvements in the bottle neck finishes of five-gallon containers have, therefore, typically been very small and subtle, because bottle manufacturers are aware of the need for existing caps to accommodate their bottles. In order to accommodate a significantly new neck profile in a five-gallon container, a cap will need to work and seal effectively with the range of existing standard neck profiles and any the new or improved neck finish.

The closure of the present invention provides both: 1) an improved seal on the typical variety of standard neck configurations which are presently in wide circulation, and 2) a particularly effective seal on neck a finish which substantially new and different from the existing standard. This is accomplished with a cap in which there is a top which may or may not include a valve, a side wall depending from the top of the cap and a skirt extending further downwardly from the side wall. On the inside surface of the cap, an elongated sealing flange is formed and extends down-outwardly from the outer margin of the underside of the top of the cap. The lower tip of the sealing flange is preferably disposed outside, or outwardly in the radial direction, from the inside diameter of the latching bead formed at the base of the side wall of the cap. To avoid misalignment or twisting of the sealing flange, the inside surface of the wedge-shaped sealing flange is preferably disposed at an angle of greater than 90° (e.g. 109°) from the plane of the top of the cap. The sealing flange of the cap of the present invention is substantially longer in length than sealing flanges typically used on the inside surface of five-gallon caps. The sealing flange of the present invention has a height which is approximately one-third of the overall distance between the underside of the top of the cap and the latching bead at the base of the side wall of the cap. In a preferred embodiment which is particular suitable for use in conjunction with a particular (and not presently standard) neck finish, the side wall of the cap includes a concave section immediately above the latch bead, and an adjacent stop above the concave section which has a slightly convex configuration which provides a way of locating the outside surface of the neck finish relative to the sealing flange. This stop helps to ensure that the position of the neck finish results in a consistent pressure being applied at the interface between the sealing flange and the upwardly facing surface of the neck finish. Also, the extended-length sealing flange of the cap of the present invention enhances the stability of liners which are sometimes used in five gallon caps by ensuring that the liner remains centered around the opening of the container. The sharp tip of the sealing flange and the lateral movability of the tip, as the cap is installed, provide a tension in the liner which improves its sealing effect. This improved stability of liners afforded by the cap of the present invention is particularly advantageous in standard (i.e. non-valved) caps, it is also true in valved caps where a donut-like liner is used surrounding the recess in the center of such caps.

The cap of the present invention is intended for use on bottles with relatively wide or semi-wide mouth necks, i.e. necks on the order of about 55 millimeters or about 2 inches. The terms "semi-wide mouth" and "semi-wide" are intended herein to refer to the kinds of neck configurations which are typically used on 5-gallon containers in the bottled water industry in the United States. Containers of this type present unique challenges to cap manufacturers for a number of reasons, such as: 1) the bottles are re-used many times before they are discarded, and in the process of use, re-sue filling and transportation the surfaces which are to be used as sealing surfaces may receive damage of varying degrees of severity, 2) they are stored for varying periods in unpredictable environments, 3) they are handled repeatedly by all kinds of persons, including consumers, delivery personnel and workers at bottling facilities, 4) the size of the semi-wide mouth opening in bottles such as 5-gallon water bottles is substantially greater than openings in other containers in which liquids are delivered to consumers, 5) semi-wide mouth containers of bottled water are often shipped, and sometimes stored, in a horizontal position with water pressure constantly pressing against the seal formed by the closure. For these reasons, the effective sealing of semi-wide mouth container necks presents unique challenges to closures manufacturers.

The foregoing advantages of the present invention will be better understood upon a reading of the specification set forth below in conjunction with the accompanying drawings.

DETAILED DESCRIPTION OF THE INVENTION

Figure 2:
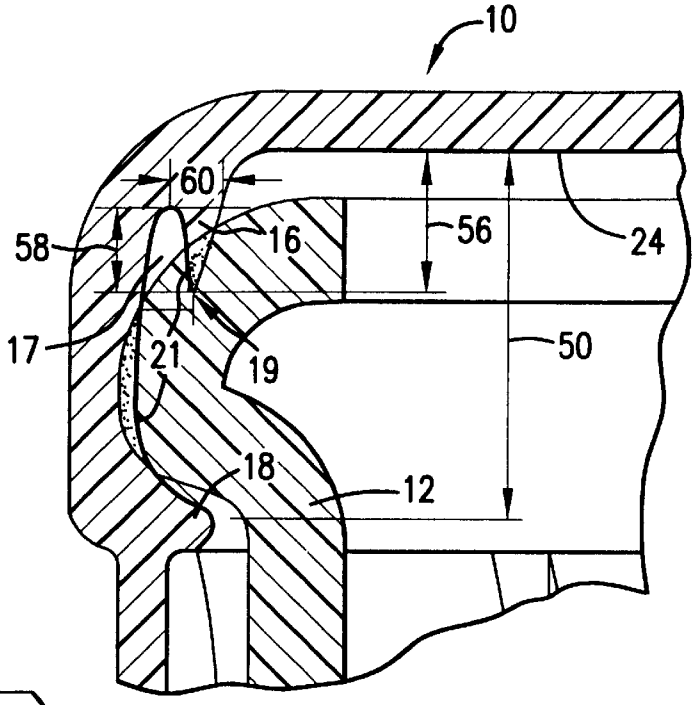
FIG. 2 is a diagram showing a cross-sectional view of the cap of the present invention in relation to a modified neck finish, and the overlapping relationship thereof.
Figure 3:
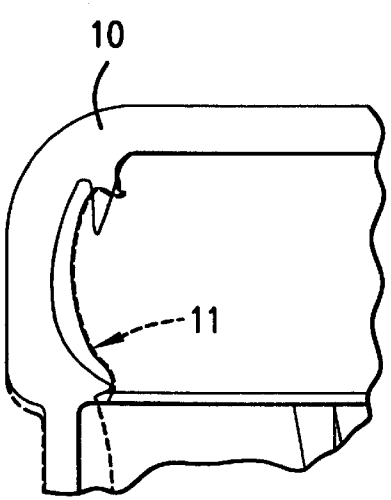
FIG. 3 is a diagram showing the extent to which a cap of the present invention (solid lines) differs from the prior art cap shown in FIG. 1 (dotted lines).
Figure 1:
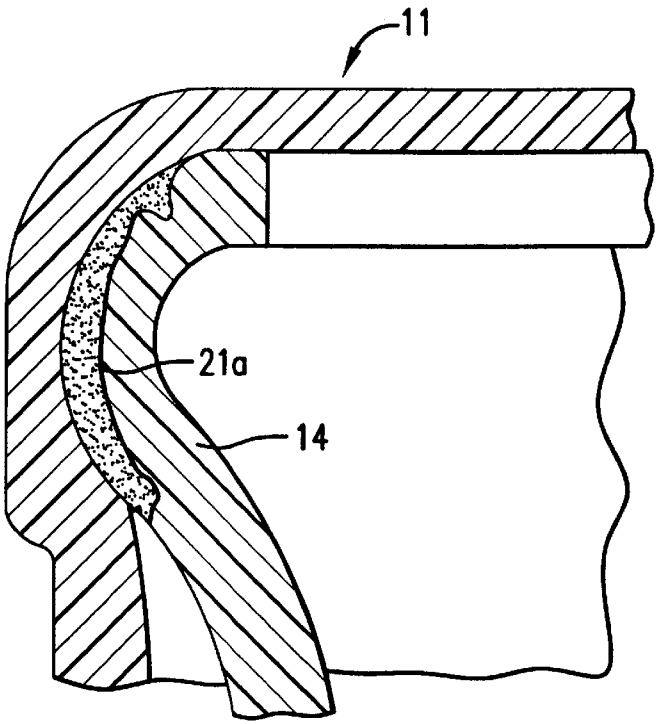
FIG.1 PRIOR ART
FIG. 1 is a diagram showing a prior art closure and a standard neck finish, and the overlapping relationship thereof.

FIGS. 1 through 3 show the significant differences between a standard five-gallon cap 11 and a cap of the present invention 10. The area 21*a* shown in FIG. 1 represents the extent to which the cap 11 needs to be displaced in order to fit on a standard bottle neck 14, i.e. the at rest or unstretched or nominal, as molded, configuration of a prior art cap 11 are superimposed upon the dimensions of a standard bottle neck 14. In contrast, the area 21 shown in FIG. 2 represents a much smaller amount of displacement required when the cap 10 of the present invention is placed on a modified bottle neck 12. Substantially less displacement of the wall of the cap is required in the combination shown in FIG. 2, as compared with the displacement required for the combination shown in FIG. 1. When the cap 10 is used with the non-standard neck finish 12 (FIG. 2) the sidewall 20 is in substantially less tension as compared to a prior art cap 11 applied to a standard neck finish 14 (FIG. 1). As can be seen in FIG. 1, upper, lower and mid-height areas of the side wall of the cap 11 must be significantly displaced when the cap 11 is installed onto a standard neck 14, whereas when the cap 10 of the present invention is used with the neck 12 there is substantially less displacement of the side wall of the cap. High tensile forces in the walls of caps can result in failure of the cap.

FIG. 3 shows that there is also a substantial reduction in the amount of material required to make the cap 10 as compared to the cap 11. The side wall 20 of the cap 10 is substantially smaller in thickness than the corresponding side wall of the cap 11.

Another substantial difference between the cap 10 and the cap 11 is the space between the uppermost portion of the bottle neck 12 and the underside 24 of the top 22 of the cap 10. While the cap 10 is shown in combination with a modified bottle neck 12, it should be noted (See FIGS. 6 and 7) that the cap 10 is capable of effectively gripping and sealing a standard bottle neck configuration, such as the neck 14 shown in FIG. 1.

Figure 4:
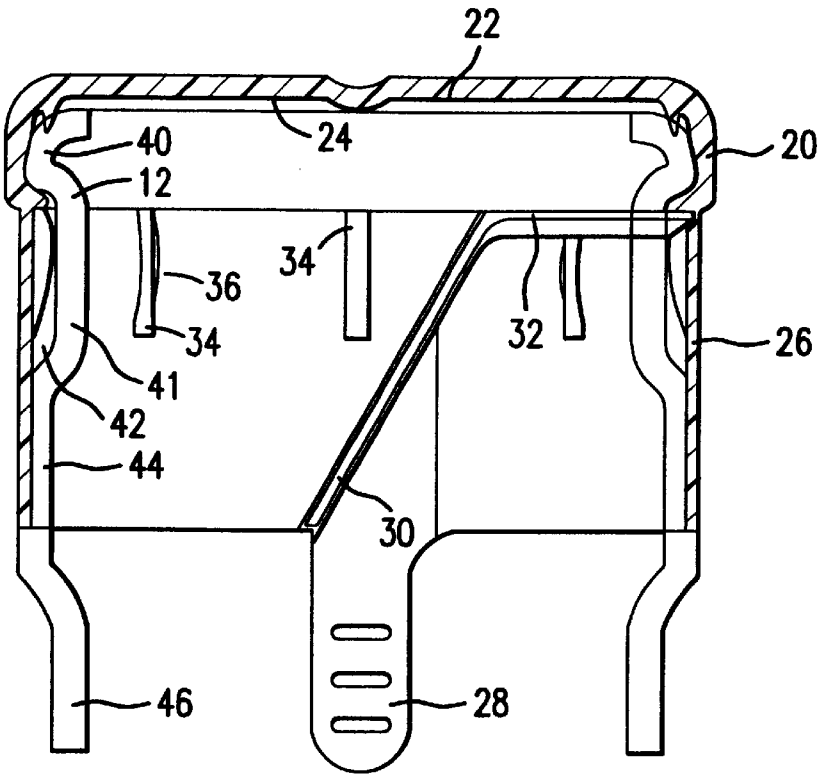
FIG. 4 is a sectional view of a cap of the present invention with a modified bottle shown positionally in relation to the cross-section of the cap.

FIG. 4 shows the overall arrangement of the elements of the cap 10. A top 22 has a generally planar undersurface 24. However, the cap may include a valve of the type which can be seen in U.S. Pat. Nos. 5,957,316; 5,121,778; or 4,699,188; and the like. The top 22 is surrounded by a downwardly depending side wall 20 from which there extends in a further downward direction a skirt 26. At the bottom edge of the skirt 26, there is a pull-tab 28 which allows the removal of the cap by hand with the cooperation of the diagonal scoreline 30 and the partially circumferential horizontal scoreline 32, which extends from the diagonal scoreline 30. It should be noted that the pull-tab and scoreline are optional features which may be eliminated in situations where a bottler has automated machinery for removing the bottle cap upon return of a bottle to a bottling facility. This option would only be useful in situations where the cap is a valved cap and is not intended to be removed by a consumer at the consumer's place of business.

Figure 5:
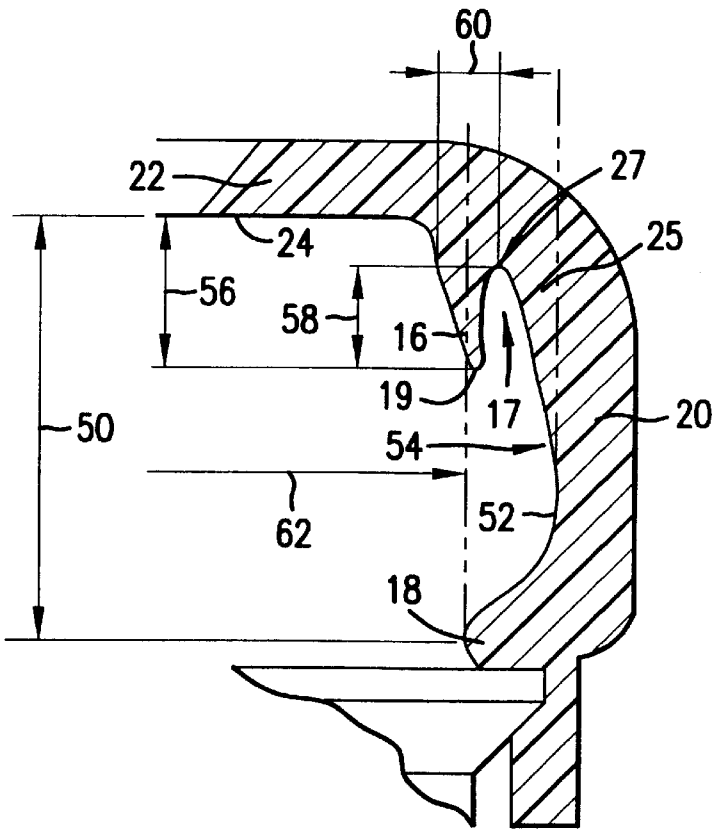
FIG. 5 is an enlarged cross-sectional view of a cap embodying the present invention.

The cap 10 shown in FIGS. 4 and 5 has a sealing flange 16 which extends down-outwardly from the underside 24 of the top 22. An opening 38 in the container neck 12 allows water or other liquid held in the container to exit the container. The neck 12 includes an upper neck portion 40, a reduced diameter section 41 forming a circumferential recess 42, and a skirt bearing zone 44 is surrounded in a close-fitting manner by the skirt 26 of the cap 10. Below the skirt bearing zone 44 there is a lower neck section 46. The cap 10 has a series of ramps 36 and vent 34 on the inside surface of the skirt 26.

To facilitate removal of the cap by user the lower edge of the skirt 26 has a pull tab 28 and an upwardly extending scoreline 30 which connects generally smoothly to a partially circumfirential scoreline 32. It is important to note that a pull tab 28 and scorelines 30 and 32 allow consumers to remove the cap prior to placement onto a cooler, while at the same time provide a tamper-evident feature to the cap. However, it is also important to note that when a valved cap is used, the consumer does not need to remove the cap prior to placement on a cooler, and this makes the pull tab 28 and scorelines 30 and 32 non-essential features on unvalved caps. Indeed, many bottlers have cap removing machines for removing valved bottle caps from empty bottles, and prefer that the caps not be removed by anyone other than the bottlers themselves. Thus, caps with valves may not need a pull tab.

FIG. 5 is an enlarged cross-sectional view of the side wall 20 and the sealing flange 16 of the present invention. The latch bead 18 extends down-inwardly from the lower end of the side wall 20. The sealing flange 16 extends down-outwardly from the underside 24 of the top 22. The sealing flange 16 is configured to have a vertical height shown by dimension line 56 measured from the undersurface 24 of the top 22 to the lower extremity 19 of the sealing flange 16. A slot 17 is defined by the space between the sealing flange 16 and the upper portion 25 of the side wall 20. The base width of the flange 16 is shown by dimension line 60 and is measured laterally from the uppermost portion 27 of the slot 17 to the inside surface of the sealing flange at the elevation of the uppermost portion 27. The axial length of the slot 17 is represented by the dimension line 58 and is measured from the uppermost portion 27 of the recess 17 to the lower extremity of the tip 19 of the sealing flange 16. The sealing flange 16 preferably has a substantial amount of flexibility as provided by the height to width ratio of the sealing flange, i.e., the ratio of the height 58 of the sealing flange 16 to the base width 60 to which is preferably about 1.6, and is preferably at least 1 or more. A sealing flange with a height-to-basewidth ratio in the range of about 1.4 to about 1.8 provides cap with the sealing ability needed to accommodate caps of varying shapes and surface characteristics. However, the basewidth dimension 60 of the sealing flange 16 should be preferably be substantial (about 0.05 inches) so as to give the sealing flange the ability to withstand shearing forces that may transferred to the sealing flange if excessive downward forces are applied as the cap is installed onto a neck.

The sealing flange 16 of the cap 10 shown in FIG. 5 also extends in a down-outward direction from the underside 24 of the top 22 a radial extent which, as shown, exceeds the inside diameter 62 of the latch bead 18. Extending the tip 19 of the sealing flange to a point radially to an extent which equals or exceed the I.D. 62 of the latch bead 18 helps to ensure that the sealing flange 16 will be consistently deflected outwardly by the upwardly-outward facing surface of the neck of the container. The consistent deflection of the sealing flange 16 is also assisted by the fact that the sealing flange extends downwardly by a significant amount from the underside 24 of the top 22. As shown in FIG. 5, the tip 19 of the sealing flange 16 is disposed a distance 56 from the surface of the underside 24 of the cap 10. The innermost tip of latch bead 18 is disposed a distance 50 from the surface of the underside 24 of the cap 10. The relationship between: 1) the extent 56 to which the tip 19 of sealing flange 16 extends downwardly from the underside 24 and 2) the extent 50 to which the latch bead 18 is space from the underside 24, defines a ratio (the flange-to-bead axial length ratio) which is preferably about 1 to about 3 in the cap of the present invention. As can be seen by comparing the flange-to-bead axial length ratio the prior art cap 11 of FIG. 1, to the flange-to-bead axial length ratio of the cap 10, it can be seen that the axial penetration of the sealing flange 16 of the cap 10 of the present invention is substantially greater than that of the prior art cap 11. The increased axial penetration of the sealing flange 16 into the space in the upper part of the cap affords the cap 10 with a capability of sealing effectively against standard and non-standard neck finishes.

The side wall 20 of the cap 10 shown in FIG. 5 includes a substantially concave area 52 above the latch bead 18. This recessed or concave area 52 is intended to accommodate and provide a seat for the outwardly facing portion of the modified neck 12. The sidewall 20 of the cap 10 further includes a stop 54 in the form of a slightly convex or inwardly protruding area immediately above the concave area 52. The combination of the stop 54 and the concave area 52 provide a way of locating the cap 10 elevationally with respect to the bottle neck 12. This provides a way of controlling the deflection of the sealing flange 16 as it is contacted by the upward-outwardly facing sealing surface of the bottle neck 12.

Figure 7:
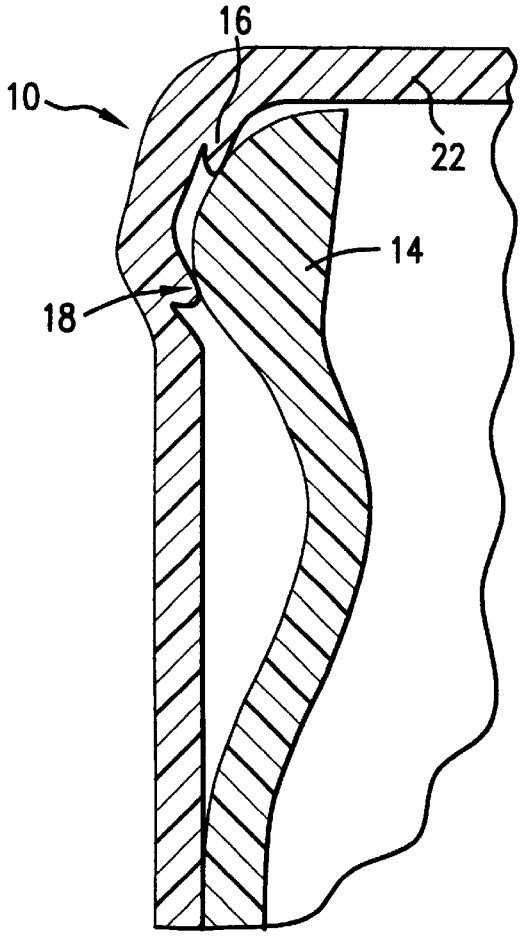
FIG. 7 is a cross-sectional view of a cap of the present invention installed on a standard bottle neck with a standard neck finish.

FIG. 7 shows the cap 10 of the present invention installed on a bottle with a standard neck finish 14. In this case there is a two-point gripping and sealing configuration with the sealing flange 16 provides a down-inward pressure, forming a first seal, and the latch bead 18 provides an upward and inward pressure, forming a secondary seal.

Figure 8:
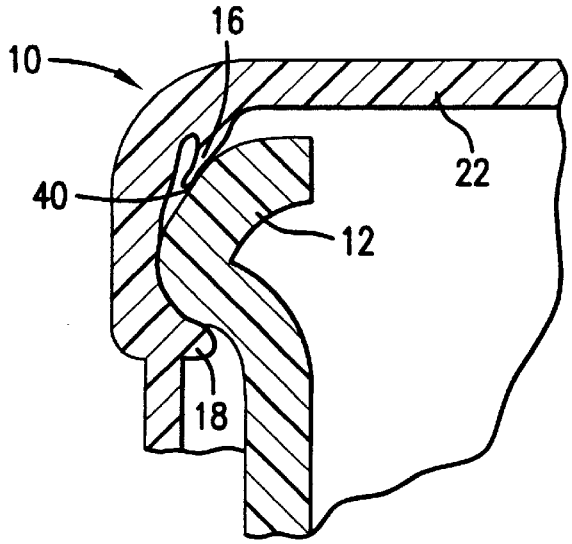
FIG. 8 is a cross-sectional view of a cap of the present invention installed on a container with a non-standard neck finish.

FIG. 8 shows the cap 10 of the present invention installed on a bottle with a new neck finish 12. In this case the outermost portion of the neck finish nests into the concave section 52 and the wiper-like sealing flange 16 is deflected to as to optimally seal an upwardly facing surface of the neck finish 12 and the latch bead extends well underneath the radially extending and more highly curved neck finish 12.

Figure 6:
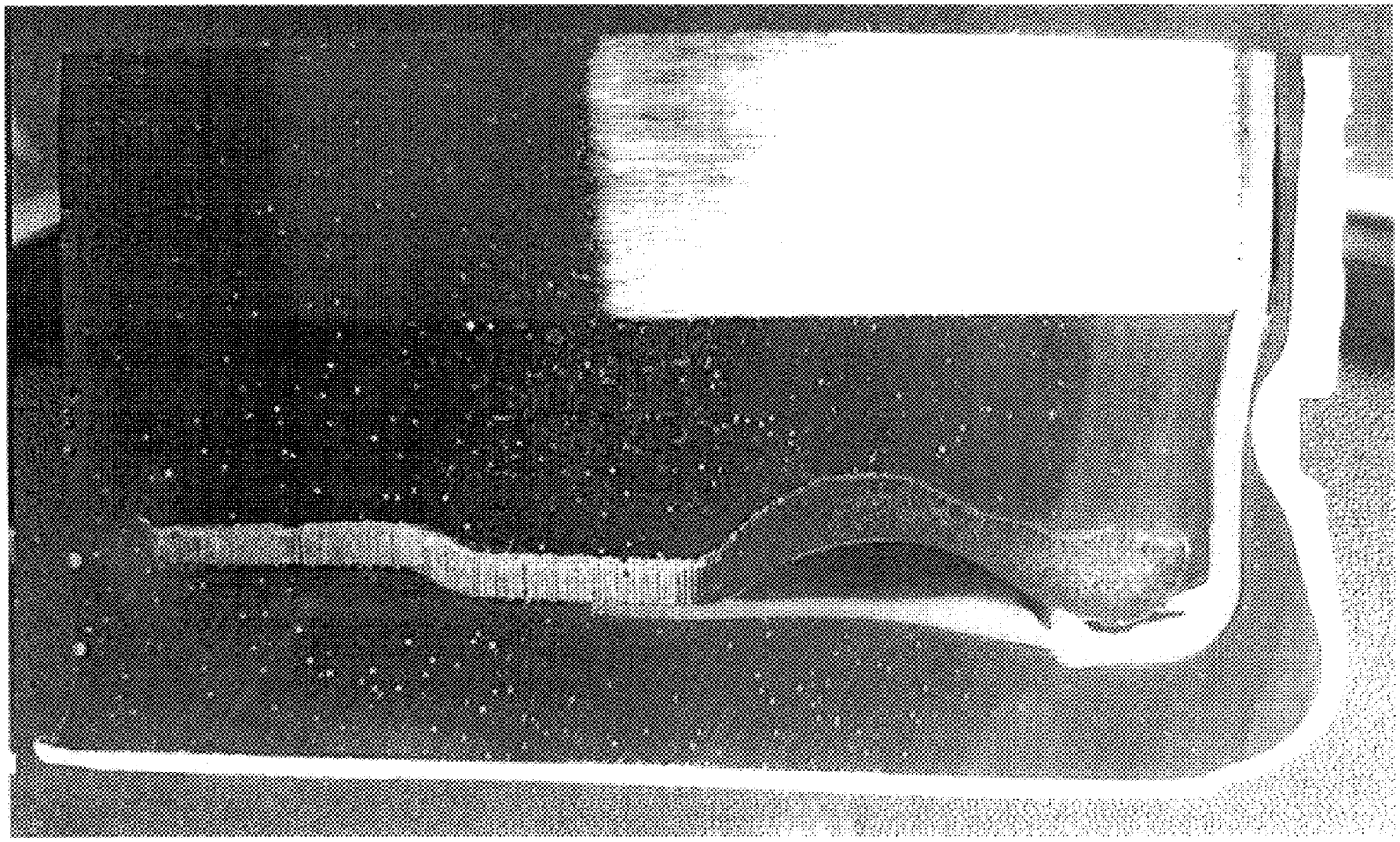
FIG. 6 is a photograph of a cap of the present invention applied to a standard five gallon container with a standard neck finish.

The photograph of FIG. 6 shows a cap 10 as installed on a standard neck finish 14, as shown in FIG. 1. When the cap 10 is installed on a standard neck 14 instead of the modified neck 12, the sealing flange 16 and the latch bead 18 cooperate to form a two-point gripping arrangement whereby the sealing flange 16 contacts the upwardly facing curved sealing surface of the standard neck 14 while the latch bead 18 contacts the down-outwardly facing curved sealing surface of the standard neck 14. When the cap 10 is used with a standard neck 14, the cap 10 performs substantially differently than in the situation where the cap 10 is applied to a modified neck 12 of the type shown in FIG. 2. When the cap 10 is applied to a standard neck 14, the concave area 52 and stop 54 may not be contact with the outside sealing surface of the neck finish of the standard neck 14. Nevertheless, the configuration of the cap 10 of the present invention is designed to effectively grip and seal the substantially different neck configurations represented by the neck 12 and the neck 14 shown in FIGS. 2 and 1, respectively.

Figure 9:
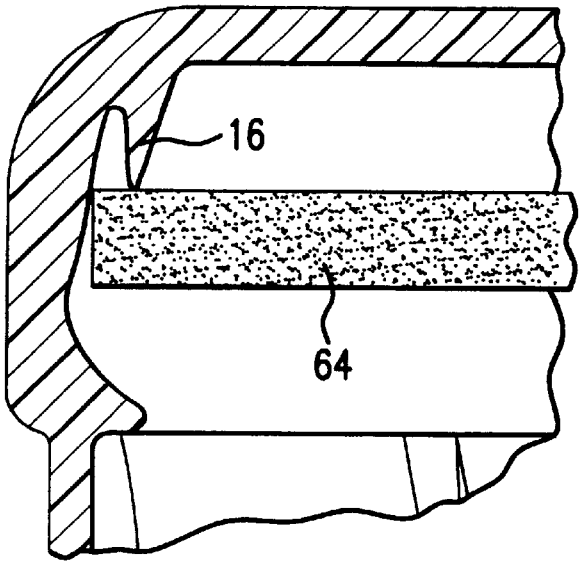
FIG. 9 is an enlarged cross-section of a cap of the present invention with a liner, prior to installation on a container.
Figure 10:
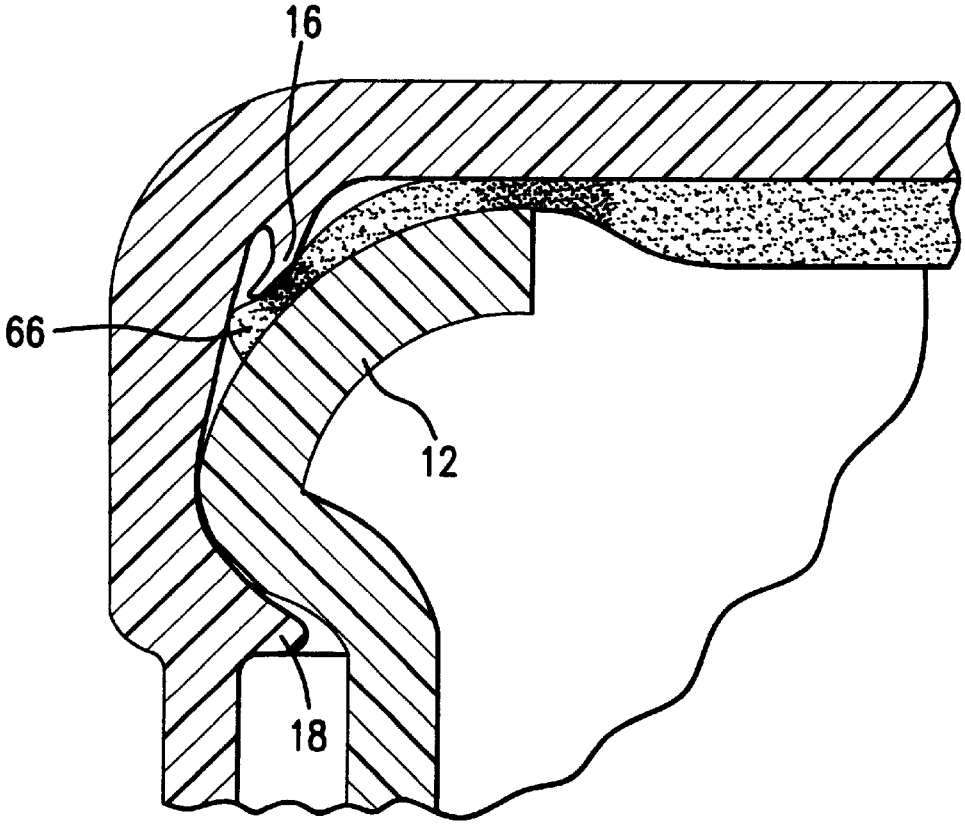
FIG. 10 is an enlarged cross-section of a cap of the present invention with a liner after it has been installed on a container.

FIGS. 9 and 10 show the cap 10 of the present invention in combination with a liner 64. The liner is initially shown in FIG. 9 held (perhaps by friction or an interference fit) on the inside the cap 10. This is how the cap would be delivered to the bottler. FIG. 10 shows how the sealing flange tends to induce a radial tension in the liner as the liner is compressed and the sealing flange deflected outwardly upon installation of the cap onto a neck finish. The sharp tip 19 of the sealing flange easily engages the soft liner (typically a foam material). This engagement prevents the liner from becoming misaligned, which in some instances can cause the liner to fall into the inside of the bottle and to become visible on the surface of the water when the bottle is inverted. The sealing flange 16 tends to hold the liner in a central position inside the cap during installation, and it pushes the periphery 66 of the liner outwardly as the periphery 66 is compressed during installation of the cap.

The foregoing descriptions of specific embodiments of the present invention have been presented for purposes of illustration and description. They are not intended to be exhaustive or to limit the invention to the precise forms disclosed, and obviously many modifications and variations are possible in light of the above explanations of the specific embodiments. The embodiments were chosen and described in order to best explain the principles of the invention and some of its practical applications, to thereby enable others skilled in the art to best utilize the invention and various embodiments with various modifications as are suited to the particular use contemplated. It is intended that the scope of the invention be defined by the claims appended hereto and equivalents thereof.

What is claimed is:

1. A cap for use with bottles, including at least two different designs of bottle neck configurations, said configurations each including an upper externally facing curved sealing surface surrounding a central opening, said externally facing curved sealing surface comprising a first upwardly facing portion and a second laterally outwardly facing portion, said cap comprising:

a top, spanning and closing off said central opening, a side wall extending downwardly from an outer margin of said top, a sealing flange extending down-outwardly from an inside surface of said top; said sealing flange and said side wall defining a slot into which a portion of said sealing flange is moveable upon placement of said cap on said neck, said slot having a vertical height and a base width such that the ratio of vertical height to basewidth is at least 1.0, said side wall including an annular latch bead at a lower inside surface of said side wall, an annular concave recess above said latch bead;

said sealing flange having an inner surface extending down-outwardly from said top, said annular concave recess extending upwardly from said latch to a convex portion of an inside surface of said side wall.

2. A cap in accordance with claim 1 wherein:

said latch bead extends radially inwardly toward a central axis of said cap to define a latch bead inside diameter and said sealing flange extends radially outwardly from a central axis of said cap to define a sealing flange tip diameter, said sealing flange top diameter being approximately equal to or greater than said latch bead inside diameter.

3. A cap in accordance with claim 1 wherein:

a tip of said sealing flange extends downwardly from an inside surface of said top by a first axial distance, and said latch bead has a minimum inside diameter at an elevation disposed a second distance from said inside surface of said top, the ratio of said first distance and said second distance being at least about 1 to 3.

4. A cap in accordance with claim 1 wherein:

said slot has a slot width approximately equal to said base width of said sealing flange.

5. A cap for use with bottles, including at least two different designs of bottle neck configurations, said configurations each including an upper externally facing curved sealing surface surrounding a central opening, said externally facing curved sealing surface comprising a first upwardly facing portion and a second laterally outwardly facing portion, said cap comprising:

a top, spanning and closing off said central opening, a side wall extending downwardly from an outer margin of said top, a sealing flange extending down-outwardly from an inside surface of said top; said sealing flange and said side wall defining a slot into which a portion of said sealing flange is moveable upon placement of said cap on said neck, said slot having a vertical height and a base width such that the ratio of vertical height to basewidth is at least 1.0, said side wall including an annular latch bead at a lower inside surface of said side wall, an annular concave recess above said latch bead; said sealing flange having an inner surface extending down-outwardly from said top, and said sealing flange having a tapering wedge-like shape terminating at a tip at its lower end, a liner made of soft pliable sealing material, peripheral portions of said liner being disposed beneath said top and extending radially to an extent at least a far from a centerline of said cap to a position underneath said tip of said sealing flange, said sealing flange engages said liner upon deflection of said sealing flange to create tension in said liner as said cap is installed on a bottle.

6. A closure assembly, comprising:

a bottle neck and cap for use with bottles, including at least two different designs of bottle neck configurations, said configurations each including an upper externally facing curved sealing surface surrounding a central opening, said externally facing curved sealing surface comprising a first upwardly facing portion and a second laterally outwardly facing portion, said cap having a top, spanning and closing off said central opening, a side wall extending downwardly from an outer margin of said top, a sealing flange extending down-outwardly from an inside surface of said top; said sealing flange and said side wall defining a slot into which a portion of said sealing flange is moveable upon placement of said cap on said neck, said slot having a vertical height and a base width such that the ratio of vertical height to basewidth is at least 1.0, said side wall including an annular latch bead at a lower inside surface of said side wall, an annular concave recess above said latch bead, said sealing flange having an inner surface extending down-outwardly from said top, said annular concave recess extending upwardly from said latch to a convex portion of an inside surface of said side wall;

said sealing flange being deflected into said slot by said first upwardly facing portion of said externally facing curved sealing surface upon placement of said cap on said neck;

said latch bead being in gripping contact with said second laterally outwardly facing portion of said externally facing curved sealing surface upon placement of said cap on said neck;

said upper externally facing curved sealing surface and said inside surface of said top defining a space between said first upwardly facing portion of said bottle neck and said inside surface of said top;

a liner made of soft pliable sealing material, peripheral portions of said liner being disposed beneath said top and extending radially to an extent at least a far from a centerline of said cap to a position underneath said tip of said sealing flange, said sealing flange engages said liner upon deflection of said sealing flange to create tension in said liner as said cap is installed on a bottle.

7. A closure assembly, comprising:

a bottle neck and cap for use with bottles, including at least two different designs of bottle neck configurations, said configurations each including an upper externally facing curved sealing surface surrounding a central opening, said externally facing curved sealing surface comprising a first upwardly facing portion and a second laterally outwardly facing portion, said cap having a top, spanning and closing off said central opening, a side wall extending downwardly from an outer margin of said top, a sealing flange extending down-outwardly from an inside surface of said top; said sealing flange and said side wall defining a slot into which a portion of said sealing flange is moveable upon placement of said cap on said neck, said side wall including an annular latch bead at a lower inside surface of said side wall, an annular concave recess above said latch bead, said sealing flange having an inner surface extending down-outwardly from said top, said annular concave recess extending upwardly from said latch to a convex portion of an inside surface of said side wall;

said sealing flange being deflected into said slot by said first upwardly facing portion of said externally facing curved sealing surface upon placement of said cap on said neck;

said latch bead being in gripping contact with said second laterally outwardly facing portion of said externally facing curved sealing surface upon placement of said cap on said neck; and said upper externally facing curved sealing surface and said inside surface of said top defining a space between said first upwardly facing portion of said bottle neck and said inside surface of said top.

* * * * *